US011211215B2

(12) United States Patent
Wang

(10) Patent No.: US 11,211,215 B2
(45) Date of Patent: Dec. 28, 2021

(54) SWITCH, AND CONTROL METHOD THEREOF

(71) Applicant: GYRK INTERNATIONAL TECHNOLOGY CO., LTD., Beijing (CN)

(72) Inventor: Hai Wang, Beijing (CN)

(73) Assignee: Gyrk International Technology Co., Ltd., Beijing (CN)

( * ) Notice: Subject to any disclaimer, the term of this patent is extended or adjusted under 35 U.S.C. 154(b) by 113 days.

(21) Appl. No.: 16/484,639

(22) PCT Filed: Feb. 2, 2018

(86) PCT No.: PCT/CN2018/075076
§ 371 (c)(1),
(2) Date: Aug. 8, 2019

(87) PCT Pub. No.: WO2018/145603
PCT Pub. Date: Aug. 16, 2018

(65) Prior Publication Data

US 2019/0378669 A1 Dec. 12, 2019

(30) Foreign Application Priority Data

Feb. 8, 2017 (CN) ..... 201710068618.5

(51) Int. Cl.
*H01H 33/60* (2006.01)
*H01H 33/42* (2006.01)

(52) U.S. Cl.
CPC ..... *H01H 33/60* (2013.01); *H01H 33/42* (2013.01)

(58) Field of Classification Search
CPC ..... H01H 9/56; H01H 33/42; H01H 33/423; H01H 33/60; H01H 71/125; H01H 2009/566

(Continued)

(56) References Cited

U.S. PATENT DOCUMENTS 3,293,496 A 12/1966 Induni
4,550,356 A 10/1985 Takahashi
(Continued)

FOREIGN PATENT DOCUMENTS

CN 2503587 Y 7/2002
CN 101295591 A 10/2008
(Continued)

OTHER PUBLICATIONS

Machine Translation of Wang International Patent Document WO 2015117557 A1 Aug. 13, 2015 (Year: 2015).*
(Continued)

*Primary Examiner* — Kevin J Comber
(74) *Attorney, Agent, or Firm* — Jenkins, Wilson, Taylor & Hunt, P.A.

(57) ABSTRACT

The present disclosure provides a high voltage and high current switch with zero-phase waiting and a control method. The switch includes two or more switching units connected in series, each of the switch unit modules includes a main switch circuit, an auxiliary switch circuit, a voltage-equalizing power supply circuit unit, a switch control and communication circuit unit, and a current transformer; and the auxiliary switch circuit and the voltage-equalizing power supply circuit unit are connected in parallel between two ends of the main switch circuit, and the current transformer is connected to the main switch circuit; an output of the current transformer is connected to the voltage-equalizing power supply circuit unit which supplies power to the switch control and communication circuit unit, and the switch control and communication circuit unit is configured to control the closing and opening of a main relay and an auxiliary relay.

7 Claims, 4 Drawing Sheets

(58) Field of Classification Search
USPC ..... 307/133
See application file for complete search history.

(56) References Cited

U.S. PATENT DOCUMENTS

| | | | | |
|---|---|---|---|---|
| 10,217,585 | B2 | 2/2019 | Wang | |
| 2010/0171433 | A1* | 7/2010 | Utsuno | H05B 41/2827 315/219 |
| 2016/0334812 | A1* | 11/2016 | Zikes | G05D 23/1905 |

FOREIGN PATENT DOCUMENTS

| | | | | |
|---|---|---|---|---|
| CN | 101587785 | A | 11/2009 | |
| CN | 102623220 | A | 8/2012 | |
| CN | 103928913 | A | 7/2014 | |
| CN | 104252995 | A | 12/2014 | |
| CN | 102623220 | B | 5/2016 | |
| CN | 106653433 | A | 5/2017 | |
| CN | 104252995 | B | 6/2019 | |
| EP | 3104486 | A1 | 12/2016 | |
| EP | 3582241 | A1 | 12/2019 | |
| JP | S59-105226 | A | 6/1984 | |
| JP | S60167211 | A | 8/1985 | |
| WO | WO 2009/121695 | A1 | 10/2009 | |
| WO | WO-2015117557 | A1 * | 8/2015 | H01G 4/258 |
| WO | WO 2018/145603 | A1 | 8/2018 | |

OTHER PUBLICATIONS

Machine Translation of Wang Chinese Patent Document CN 102623220 A Aug. 1, 2012 (Year: 2012).*

Chinese Office Action for Application No. 201710068618.5 dated Aug. 18, 2020.

European Search Report for Application No. 18751038.3 dated Oct. 15, 2020.

Chinese Office Action for Application No. 201710068618.5 dated Mar. 18, 2020.

International Search Report and Written Opinion for Application No. PCT/CN2018/075076 dated May 2, 2018.

* cited by examiner

SWITCH, AND CONTROL METHOD THEREOF

CROSS REFERENCE TO RELATED APPLICATION

The present application is a national stage application under 35 U.S.C. 371 based on international patent application PCT/CN2018/075076, filed on Feb. 2, 2018 which claims the priority of Chinese patent application No. 201710068618.5 filed on Feb. 8, 2017, the disclosures of both of which are incorporated in the present application by reference in their entireties.

TECHNICAL FIELD

The present application relates to the field of electrical load switches in electrical engineering, in particular to a high-voltage and high-current switch with zero-phase waiting.

BACKGROUND

Load switches and circuit breakers are an integral part of a power distribution system and are used to turn the power on or off. The traditional load switch and circuit breaker are all closed or opened by mechanical contacts. It is a problem difficult to be solved that arcing and arc reignition are formed in a high voltage switch when the switch contacts are disconnected due to a long contact stroke. The traditional switches use various physical arc extinguishing methods to reduce and avoid arcing when the switch contacts are closed and when the switch contacts are open. From the principle of arc extinguishing and the level of voltage used, there are gas-producing arc extinguishing, vacuum arc extinguishing, oil arc extinguishing, SF6 arc extinguishing, etc. Occurrences of sparking or arcing are reduced or avoided at the instant that the switch closes or opens by the above-mentioned arc-extinguishing mode of the load switch or circuit breaker, thereby ensuring the integrity of the switch contacts and the effective disconnection of the switch. With the increase of switching off voltage, the complexity and cost of arc extinguishing device increase correspondingly. The insulation and arc extinguishing properties of SF6 are much higher than those of vacuum or insulating oil. Because of the high cost of application and operation of SF6 gas, it is only used at the voltage level above 110 kV. Due to damage of the SF6 to the environment, in the field of ultra-high voltage load switches a material is searched for to replace SF6, but no ideal solution is found.

The existing switch contacts withstand huge surge current or high voltage pulse at the moment of closure and disconnection. On the one hand, it will greatly reduce the service life of the switch contacts, on the other hand, it will pollute the power grid. This kind of high voltage pulse or surge current may cause damage to electrical appliances in the power grid. If the switch contacts are operated at zero current or voltage, without the energy of gas ionization, there will be no ignition or arc. Obviously, the traditional mechanical contact switches cannot solve this problem. All kinds of existing power switches are designed on arc extinguishing. The purpose of putting the contacts of the switches in vacuum or SF6 gas environment is to reduce the possibility of gas ionization at both ends of the contacts. Another important factor that generates the arc is the "current", but few people think about solutions from it. If the switch contacts can act instantaneously at the AC zero point, it can also ensure that no arc occurs when the contacts act. But it seems almost impossible to make the switch contacts act at the zero point of AC, which is as difficult as shooting through a high-speed rotating fan blade.

SUMMARY

Technical Problems

Chinese patent No. ZL201110034379.4 discloses a high-voltage electronic arc extinguishing switch, which uses a group of circuits of auxiliary relay contacts and diodes in series to protect a main switch, and proposes a solution that the switch contacts act instantaneously at a zero point of an alternating current. But the disadvantage of this patent is that all switch contacts are controlled by a switch control module, and each of relay switch contacts and coils has to withstand a very high voltage, so this high-voltage load switch scheme has little practical value in the field of tens of thousands volts high-voltages or more.

Conventional switches are single contacts, because multiple switches in parallel cannot solve the current sharing problem of switch branches. As a result, the switch branch with the largest current will easily be burned first, and then the distribution current of other switch branches increases, which accelerates the damage of all switch branches. For the single contact switch, the higher the current, the more complex the contact operation mechanism is. The single contact switch also causes the cost of the contact operation mechanism to rise and the reliability to decrease. On the other hand, even the skin effect of power frequency AC cannot be neglected when the current is high. The increase of wiring and contact resistance caused by skin effect of single contact switch at high current is also difficult to solve.

Technical Solutions

The object of the present application is to provide an air contact high voltage and high current phase switch, that is, a high voltage switch that does not require vacuum, insulating oil or SF6 gas protection. The closing and opening of the contacts of such a switch is instantaneously operated at a zero point of the alternating current, and no inrush current or overvoltage is generated during the switching operation.

The object of the present application is to be realized by the following technical scheme:

The application provides a high-voltage and high-current switch with zero-phase waiting, which includes two or more switch unit modules in series;

the switch unit module consists of a main switch circuit, an auxiliary switch circuit, a voltage-equalizing power supply circuit unit, a switch control and communication circuit unit, a current transformer, etc., and the auxiliary switch circuit and the voltage-equalizing power supply circuit unit are connected in parallel at both ends of the main switch circuit; an output of the current transformer is connected to the voltage-equalizing power supply circuit unit, which supplies power to the switch control and communication circuit unit, and the switch control and communication circuit unit is configured to the closing and disconnecting of a main relay and an auxiliary relay; and the auxiliary switch circuit is a circuit including a diode and a relay contact connected in series.

The voltage-equalizing power supply circuit unit uses a capacitance voltage-reducing circuit as a power supply input, when the main switch is turned off. When the main switch is closed, an output of the current transformer is rectified and used as power input.

The switch control and communication circuit unit is connected to a communication module such as an optocoupler, an optical fiber, an infrared or a Bluetooth.

The main switch of the switch unit module can be a vacuum bubble, and the auxiliary switch circuit may be composed of two or more series circuits each including relay switch contacts and the high voltage diode.

The switch unit module consists of more than two main switch circuits and more than two auxiliary switch circuits. All the main switch circuits and auxiliary switch circuits are connected in parallel, and each main switch circuit is connected with a current transformer.

The control method of the high current switch unit module includes the following steps:

when the main switches are closed, the current of each of the switch contact branches is detected, and the current signal of the each of the switch contact branches is sent to the switch control and communication circuit unit by the current transformer of each of the switch contact branches;

when the current of one of the switch contact branches is too high, the switch contact of the one of the switch contact branches is controlled to be disconnected instantaneously by the switch control and communication circuit unit, so that average current of the one of the switch contact branches is basically equal to that of other ones of the switch contact branches, thus achieving the aim of current equalization of the switch contact branches.

The high-voltage and high-current switch with zero-phase waiting of the application realizes the connection or disconnection of the high-voltage alternating current by using air contact, solves the problem that the mechanical contact switch cannot be connected in series, there is no inrush current and sparking when the switch contact is closed, and there is no overvoltage and arcing when the switch contact is open. The switch has a simple structure and high reliability. In theory, high-voltage and high-current switch with zero-phase waiting of the present application can realize an AC power load switch of any level of high voltage and any level of high current.

BRIEF DESCRIPTION OF THE DRAWINGS

In order to more clearly illustrate the embodiments of the present application or the technical solutions in the prior art, a brief description of the drawings used in the embodiments or the prior art description will be briefly described below. Obviously, the drawings in the following description is some certain embodiments of the present application, and other drawings can be obtained from those skilled in the art without any creative work.

DETAILED DESCRIPTION

In order to make the object, technical scheme and advantages of the present application clearer, the technical scheme in the embodiments of the present application will be described clearly and completely in conjunction with the drawings in the embodiments of the present application. Obviously, the embodiments described are part of the embodiments of the present application, not all of the embodiments. Based on the embodiments of the present application, all other embodiments acquired by the ordinary skilled in the field without creative work fall within the scope of protection of the present application.

Figure 1:
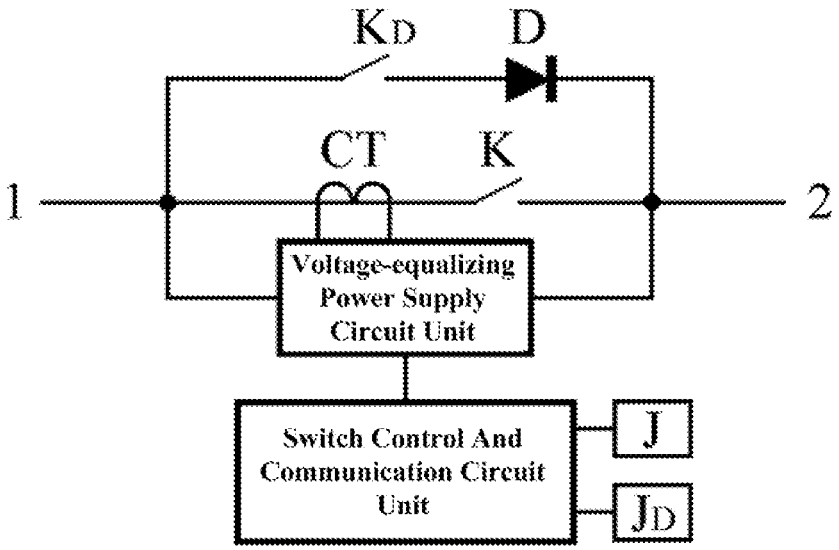
FIG. 1 is a circuit schematic diagram of a switch unit module.

The high-voltage and high-current switch with zero-phase waiting of the present application is composed of a plurality of identical switch unit modules connected in series. FIG. 1 is a circuit diagram of a switch unit module, which is composed of a main relay J (a main switch contact, i.e. a main switch, K), an auxiliary relay JD (an auxiliary switch contact, i.e. an auxiliary switch, KD), a diode D, current transformer CT, voltage-equalizing power supply circuit unit, switch control and communication circuit unit. The auxiliary relay contact KD and the diode D are connected in series to form an auxiliary switch circuit. The auxiliary switch circuit and the voltage-equalizing power supply circuit units are connected in parallel between both ends of the main switch circuit. The current transformer CT is connected to the voltage-equalizing power supply circuit unit. The voltage-equalizing power supply circuit unit provides power and AC reference for the switch control and communication circuit unit. When the main switch is in an off state, the voltage-equalizing power supply circuit unit plays the following functions: (1) Obtain power from both ends of the main switch, and supply power to the switch control and communication circuit unit after voltage-reducing, rectification, filtering and voltage regulation; (2) Obtaining a voltage signal from both ends of the main switch to provide an AC voltage time reference for the switch control and communication circuit unit; (3) At the same time, the voltage-equalizing power supply circuit unit also functions to share the voltage when the switch unit modules are connected in series. This voltage-equalizing power supply circuit unit may use a capacitance voltage-reducing circuit. The voltage-reducing capacitor not only functions to achieve voltage-reducing in the power supply circuit unit, but also functions to achieve voltage equalization if all the switch unit modules use a same capacity of the voltage-reducing capacitor. When the main switch is closed, there is no voltage between the both ends of the voltage-equalizing power supply circuit unit, and there is no power input for the voltage-equalizing power supply circuit unit. At this time, it is necessary to supply power for the switch control and communication circuit unit through current transformer. At the same time, the current transformer CT also provides AC time reference for switch control and communication circuit unit. The principle of capacitance voltage-reducing circuit and a power supply circuit using the current transformer can be realized by ordinary technical skilled person, and will not be described here.

The high-voltage and high-current switch with zero-phase waiting of the application is composed of a plurality of switch unit modules as shown in FIG. 1 connected in series. When the switch is in an open state, the main switches of all switch unit modules are in the open state, the capacitance voltage-reducing circuits of all switch unit modules work. The voltage-reducing capacitor has two functions. One of the functions is to ensure that all switches are subjected to a same voltage, and that no breakdown occurs due to the fact that a voltage on a certain switch is too high. The other one of the functions is to provide a low-voltage DC power supply for each one of the switch control and communication circuit units after rectification, filtering and regulating. When the switch is closed, each one of the main switches on all switch unit modules is closed and all switch unit module are at a same potential. Current transformers on all switch unit module provide low-voltage DC power for each one of the switch control and communication circuit units. It is the most economical and reliable way to get electricity from a power bus. If current in the power bus is very low, the energy transmitted by the current transformer is insufficient to maintain the power consumption of the switch control and communication circuit unit, other power supply modes can be considered, such as solar cells irradiated by strong light, microwave power transmission and so on.

Figure 2:
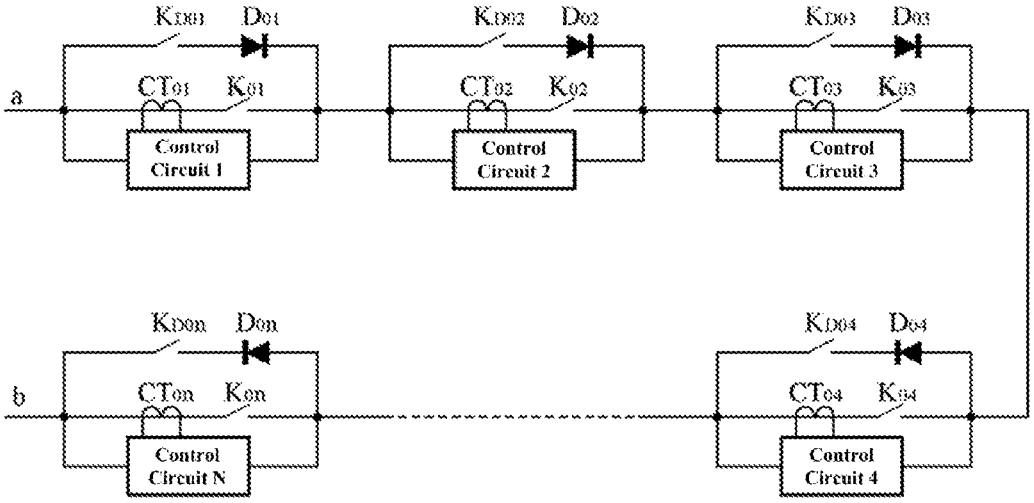
FIG. 2 is a circuit schematic diagram of a high-voltage and high-current switch with zero-phase waiting of the application.

The operation process and control method of the switch are described below with reference to FIG. 2. (The "control circuit" in FIG. 2 is a general name of the voltage-equalizing power supply circuit unit and the switch control and communication circuit unit in FIG. 1.). When each control circuit receives a switch closure command, each control circuit controls the auxiliary relay contacts KD01-KD0N to be closed during a negative half cycle of a same voltage (Uab). Then, when the voltage is in a positive half cycle, diodes D01-D0N of all auxiliary switch circuits connected in series will be turned on at the same time. And then each control circuit controls the corresponding main relay J01-J0N to be closed in the positive half cycle of the Uab. Although it is impossible for all of the main switch contacts K01-K0N to be closed at a same time, it is only necessary to complete the closing in the positive half cycle. Contact bounce will occur during the closing process of each main switch. In the instant that the contact jumps off, the current will flow through a corresponding auxiliary switch branch. The voltage on both ends of the contacts is the forward voltage of the diode, about 0.7V. As long as the main switches complete the closing and bouncing process of the contacts during the positive half cycle of the current, the ignition and inrush of the contacts will not occur. After all the main switch contacts K01-K0N (i.e. main switches K01-K0N) are closed, the auxiliary relay contacts KD01-KD0N are disconnected, that is, the closing process of the high voltage switch is completed. How to shorten operation time of relay and reduce the number of contact bouncings may be referred to the China Patent 201310265141.1, without further elaboration here. When the main switches K01-K0N are closed, the input of the voltage-equalizing power supply circuit unit of each switch unit module is short-circuited, and the corresponding capacitance voltage-reducing circuit stops working. At this time, the current transformers CT01-CT0N on the switch unit modules start to supply power to the switch control and communication circuit units, provide AC time reference for switch control and communication circuit units, and at the same time, measure the current through the switch and transmit the current data from the switch control and communication circuit units. When all of the control circuits receive a switch-off instruction, the control circuits will control all of the auxiliary relay contacts KD01-KD0N to close first, and then control the main switches K01-K0N to open during the positive half cycle of lab current. All of the switch contacts K01-K0N cannot be disconnected at the same instant. The current of the main switch K that is first disconnected will flow from the series branch of the auxiliary relay contact KD and the diode, ensuring that current of the entire series switch circuit is continuous, and the disconnected main switch K is only subjected to conduction voltage between the both ends of the diode-, about 0.7V, and the main switch does not cause arcing. After the main switches K01 to K0N of all switch unit modules are completely disconnected during the positive half cycle of the current, the current flows through the auxiliary switch circuits KD01-D01 to KD0N-D0N. At the end of the positive half cycle of the current, the diodes of the auxiliary circuits of all switch unit modules are immediately turned off. During the following diode off time, the control circuits control the auxiliary switch contacts KD01-KD0N to open, and the disconnection process of the high voltage switch is completed.

During the closing and opening of the switch, the diode of each auxiliary branch is automatically turned on or off when the phase of the alternating current is changed. There is no need to accurately control time of the on and off operations, and this is the so-called "waiting for zero" technology. And at the period of the closing and opening of the switch, flow through all of the main switches and the auxiliary contacts will withstand no voltage. Therefore, the switch contacts do not ignite or pull the arc during the action of the switch. This greatly increases the electrical life of the switch contacts, and this is not possible to be achieved with traditional mechanical contact switches.

Every switch units need to act harmoniously and be communication connected. Various communication modes, such as optocoupler communication, optical fiber communication, infrared communication, Bluetooth communication and the like, can be used between each switch unit module and an external controller, and between switch unit modules. The wireless Bluetooth communication mode has the advantages such as a high security, a high communication rate, a low power consumption and low cost.

As mentioned above, each switch unit module uses a separate power supply. The main switch and the auxiliary switch contacts are not subjected to electrical stress and will not ignite or arc during the closing and opening of the switch. In theory, a plurality of switch unit modules of the present application in series can compose an AC high voltage load switches of any high voltage.

Figure 3:
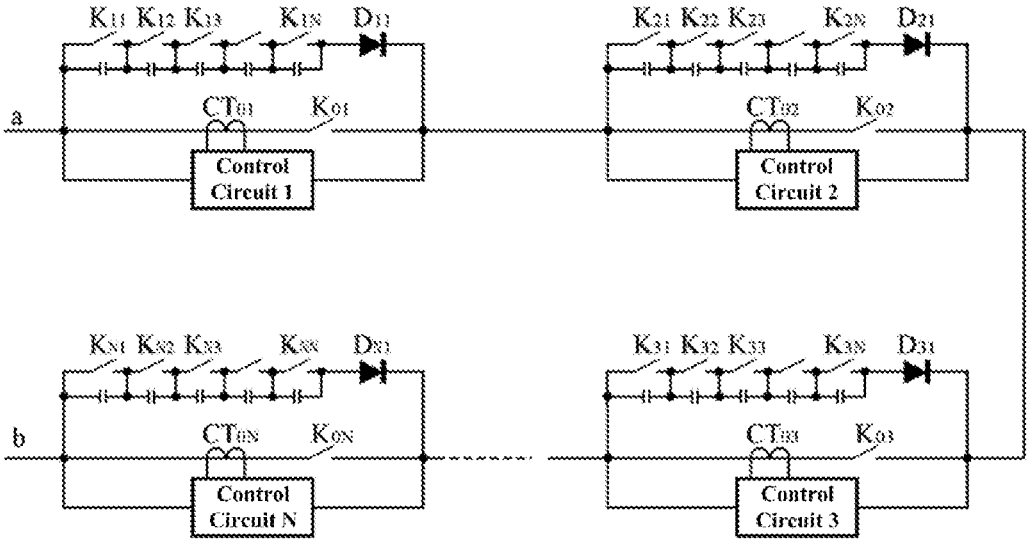
FIG. 3 is one of high-voltage and high-current switch with zero-phase waiting embodiments of the present application.

The switch of the application uses a plurality of switch unit modules connected in series. An embodiment of the present application is illustrated in FIG. 3. The main switches K01-K0N in the switch unit modules described in the figure may adopt vacuum bubbles, and the auxiliary switches may adopt ordinary relays. The general breakdown voltage of vacuum bubbles can reach 35 kV. In general, the voltage withstand between contacts of ordinary relays can easily reach 5000 Vac voltage withstand, and the voltage withstand of five relays in series will exceed 20 kV. The capacitor connected in parallel between the auxiliary relay contact acts as voltage equalizers for the auxiliary switch contact when the main switch is open. A plurality of ordinary relays is connected in series with high voltage diodes to realize the function of auxiliary switch circuit. Assuming that the withstand voltage of one vacuum circuit breaker is 20 kV, five such switch unit modules connected in series can realize 100 kV high voltage switch.

Figure 4:
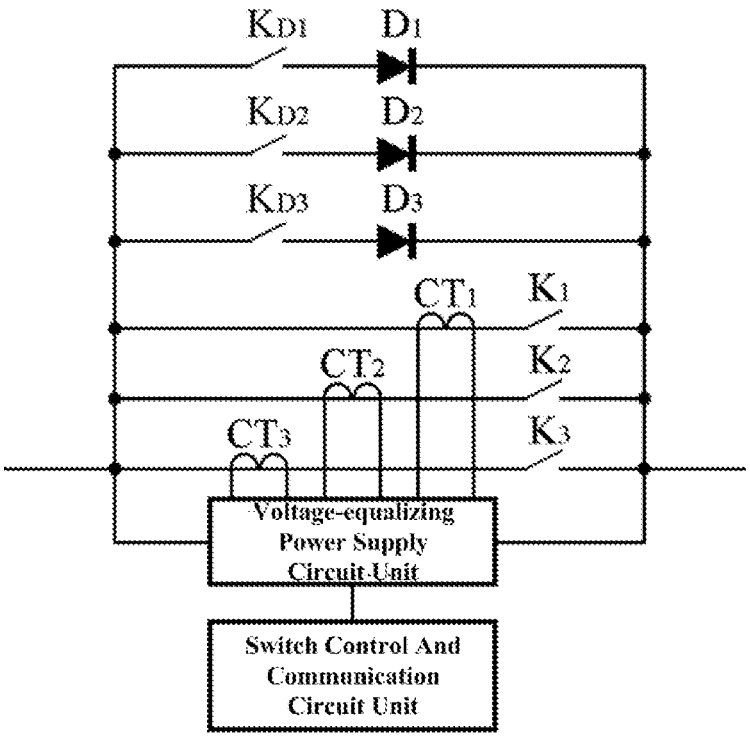
FIG. 4 is a circuit diagram of a high current switch unit module of the application.

Due to the limitation of AC skin effect, the current of single switch cannot be increased indefinitely. The application provides high current switch unit module. The high current switch unit module in FIG. 4 includes three main-switch circuits and auxiliary-contact circuits. The high current switch unit module is formed by connecting the three main-switch circuits and the auxiliary-contact circuits in parallel. A current transformer is connected to each main-switch circuit. The three parallel main switches are used to divide the current through the switch into three circuits, which can reduce the skin effect. The function of three parallel auxiliary branches is to prevent the main switch contacts from sparking or arcing when the main switch contacts are closed or disconnected. By parallel connection of multiple main switching branches and multiple auxiliary branches, arbitrary high current switching can be realized theoretically. Obviously, the number of auxiliary branches need not be the same as the number of main switch branches. The closing and opening process of the switch is similar to that of the switch described in FIG. 2, which will not be discussed here.

The current sharing control method of the high current switch unit module is described below. When the main switches are closed, the current transformer of each main switch branch detects the current of each branch, and sends the current signal of each branch to the switch control and communication circuit unit through the voltage-equalizing power supply circuit unit. When the current of a certain branch is too high, the switch control and communication circuit unit will control the contact of the branch to be disconnected for a short time. The average current through the branch is reduced and basically equal to the average current of other branches, so as to achieve the goal of current equalization of all branches. The current equalization of main switch branches can also be realized by using temperature sensor to detect switch temperature. When the switch is closed, the contact resistance of a certain main switch branch is too high, which will cause the heating temperature of the branch to be very high. The temperature change of the contact is detected by the thermistor attached to the switch contact and sent to the switch control and communication circuit unit. When the contact heat of a certain switch is much higher than that of other switches, the contact of the branch switch may be temporarily disconnected and be closed after the temperature decreases. Because the switch heating is caused by poor contact state of the contact, generally, relocation of switch contacts will reduce contact resistance and the contact state will be improved. If the contact resistance of the contact cannot be improved, the contact of the switch may work intermittently, and the switches of other branches can share the work, so as to prevent the accelerated aging damage of the faulty switch branch.

Multiple identical high current switches in series can also form a high-voltage and high-current switches. In theory, an AC high-voltage switch of any high voltage and any high current can be realized by connecting a plurality of high-current switch unit modules in parallel or in series.

Figure 5:
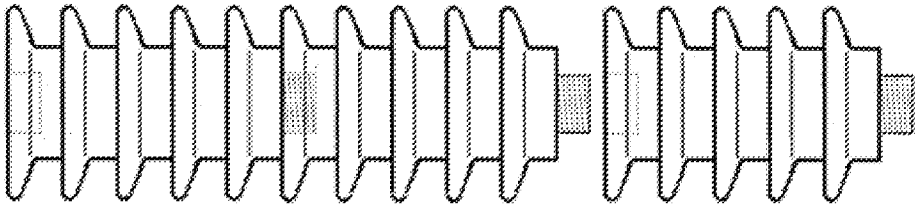
FIG. 5 is a contour diagram of an embodiment of a high-voltage and high-current switch with zero-phase waiting of the present application.

FIG. 5 is one of contour diagrams of a high-voltage and high-current switch with zero-phase waiting of the present application. The switch unit modules of the present application can be mounted in a high-voltage insulated terminal, that is, a high-voltage switch unit is constituted. One end of the terminal of the high-voltage switch is a screw and the other end is a nut, and thus the high-voltage switch units can be conveniently connected in series to form a high-voltage switch. If the withstand voltage of a high-voltage switch unit is 10 KVac, a switch of 1 KV can be made up of 100 such high-voltage switch units, however, it can only be realized by SF6 gas protection in traditional art, the volume of the switch is very large, and a large companion equipment is also needed. The high-voltage and high-current switch with zero-phase waiting of the application does not need external power supplies or auxiliary equipments, and can be installed and used very conveniently.

What is claimed is:

1. A switch, comprising two or more switch unit modules connected in series;

wherein each of the switch unit modules comprises at least two main switches, at least two auxiliary switch circuits, a voltage-equalizing power supply circuit, a switch control and communication circuit, and at least two current transformers;

wherein the voltage-equalizing power supply circuit, all of the main switches, and all of the auxiliary switch circuits are connected in parallel, each of the main switches is connected to one of the current transformers, and each of the auxiliary switch circuits comprises a diode and the auxiliary switch connected in series, wherein the diode has a same conducting direction;

an output of each of the current transformers is connected to the voltage-equalizing power supply circuit which supplies power to the switch control and communication circuit, and the switch control and communication circuit is configured to control closing and opening of the auxiliary switch and each of the main switches.

2. The switch according to claim 1, wherein the voltage-equalizing power supply circuit is configured to use an output of a corresponding one of the current transformers as a power input when one of the main switches is closed.

3. The switch according to claim 2, wherein each of the switch unit modules further comprises at least two temperature sensors, and each of the main switches is further connected to one of the temperature sensors.

4. The switch according to claim 1, wherein the switch control and communication circuit is connected to a communication circuit including an optocoupler, an optical fiber, an infrared or a Bluetooth.

5. The switch according to claim 4, wherein each of the switch unit modules further comprises at least two temperature sensors, and each of the main switches is further connected to one of the temperature sensors.

6. The switch according to claim 1, wherein each of the switch unit modules comprises at least two temperature sensors, and each of the main switches is further connected to one of the temperature sensors.

7. A control method of a switch unit module comprising the following steps:

when at least two main switches are closed, detecting current of each of main switch branches, and sending the current of each of the main switch branches to a switch control and communication circuit by a current transformer of each of the main switch branches;

when the current of one of the main switch branches is higher than a preset value, controlling the main switch of the one of the main switch branches to be disconnected instantaneously by the switch control and communication circuit, so that average current of the one of the main switch branches is equal to that of other ones of the main switch branches, thus achieving current equalization of the main switch branches;

wherein the switch unit module comprises: the at least two main switches, the at least two auxiliary switch circuits, a voltage-equalizing power supply circuit, the switch control and communication circuit, and the at least two current transformers, wherein the voltage-equalizing power supply circuit, all of the main switches and all of the auxiliary switch circuits are connected in parallel, each of the main switches is connected to one of the current transformers to form a main switch branch, and each of the auxiliary switch circuits comprises a diode and the auxiliary switch connected in series, wherein the diode has a same conducting direction; an output of each of the current transformers is connected to the voltage-equalizing power supply circuit which supplies power to the switch control and communication circuit, and the switch control and communication circuit is configured to control the closing and opening of the auxiliary switch and each of the main switches.

* * * * *